US006891501B2

(12) United States Patent
Rawnick et al.

(10) Patent No.: US 6,891,501 B2
(45) Date of Patent: May 10, 2005

(54) ANTENNA WITH DYNAMICALLY VARIABLE OPERATING BAND

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 38 days.

(21) Appl. No.: 10/330,755

(22) Filed: Dec. 27, 2002

(65) Prior Publication Data

US 2004/0125019 A1 Jul. 1, 2004

(51) Int. Cl.[7] ..... H01Q 1/38
(52) U.S. Cl. ..... 343/700 MS; 343/745
(58) Field of Search ..... 343/700 MS, 745, 343/749, 750

(56) References Cited

U.S. PATENT DOCUMENTS 6,097,271 A * 8/2000 Kozakoff ..... 333/204
6,642,902 B2 * 11/2003 Gustafson ..... 343/791

OTHER PUBLICATIONS

U.S. patent application Ser. No. 10/369,436, Rawnick et al., filed Feb. 18, 2003.
U.S. patent application Ser. No. 10/387,208, Rawnick et al., filed Mar. 11, 2003.
U.S. patent application Ser. No. 10/330,754, Rawnick et al., filed Dec. 27, 2002.
U.S. patent application Ser. No. 10/300,456, Rawnick et al., filed Nov. 19, 2002.
U.S. patent application Ser. No. 10/361,548, Rawnick et al., filed Feb. 10, 2003.
U.S. patent application Ser. No. 10/387,209, Rawnick et al., filed Mar. 11, 2003.
U.S. patent application Ser. No. 10/387,194, Brown et al., filed Mar. 11, 2003.
U.S. patent application Ser. No. 10/438,435, Brown et al., filed May 15, 2003.
U.S. patent application Ser. No. 10/414,696, Brown et al., filed Apr. 16, 2003.
U.S. patent application Ser. No. 10/637,027, Brown et al., filed Aug. 7, 2003.
U.S. patent application Ser. No. 10/414,650, Brown et al., filed Apr. 16, 2003.
U.S. patent application Ser. No. 10/635,629, Brown et al., filed Aug. 6, 2003.
U.S. patent application Ser. No. 10/459,067, Brown et al., filed Jun. 11, 2003.
U.S. patent application Ser. No. 10/438,436, Rawnick et al., filed May 15, 2003.
U.S. patent application Ser. No. 10/626,090, Brown et al., filed Jul. 24, 2003.
U.S. patent application Ser. No. 10/635,582, Rawnick et al., filed Aug. 6, 2003.
U.S. patent application Ser. No. 10/632,632, Rawnick et al., filed Aug. 1, 2003.

(Continued)

*Primary Examiner*—James Vannucci
(74) *Attorney, Agent, or Firm*—Sacco & Associates, PA

(57) ABSTRACT

An antenna (100) includes at least one antenna radiating element (108, 110) and a dielectric structure (102) defining a cavity containing a fluid dielectric (106). The dielectric structure (102) can be a dielectric circuit board substrate with a ground plane (116) provided opposed to the antenna radiating elements (108, 110). The fluid dielectric (106) is electrically and magnetically coupled to the antenna radiating element. Further, a composition processor (301) is provided for selectively varying a composition of the fluid dielectric (106) so as to dynamically change an electrical characteristic of the antenna radiating element (108) in response to a control signal.

35 Claims, 3 Drawing Sheets

U.S. PATENT DOCUMENTS

U.S. patent application Ser. No. 10/614,149, Brown et al., filed Jul. 7, 2003.
U.S. patent application Ser. No. 10/634,219, Rawnick et al., filed Aug. 5, 2003.
U.S. patent application Ser. No. 10/458,859, Rawnick et al., filed Jun. 11, 2003
U.S. patent application Ser. No. 10/624,378, Brown et al., filed Jul. 22, 2003.
U.S. patent application Ser. No. 10/438,433, Rawnick et al., filed May 15, 2003.
U.S. patent application Ser. No. 10/460,947, Rawnick et al., filed Jun. 13, 2003.
U.S. patent application Ser. No. 10/421,352, Rawnick et al., filed Apr. 23, 2003.
U.S. patent application Ser. No. 10/409,261, Pike, filed Apr. 8, 2003.
U.S. patent application Ser. No. 10/441,743, Pike, filed May 19, 2003.
U.S. patent application Ser. No. 10/628,846, Pike et al., filed Jul. 28, 2003.
U.S. patent application Ser. No. 10/300,455, Brown et al., filed Nov. 19, 2002.

* cited by examiner

ANTENNA WITH DYNAMICALLY VARIABLE OPERATING BAND

BACKGROUND OF THE INVENTION

1. Statement of the Technical Field

The inventive arrangements relate generally to methods and apparatus for multi-band microstrip antenna operation, and more particularly for dynamically changing the operational band of a microstrip antenna.

2. Description of the Related Art

A wide variety of RF antenna elements are commonly manufactured on dielectric substrate. These include common dipole antenna elements as well as a variety of patch type antennas. The band of frequencies over which such antennas will function is largely determined by the geometry of the antenna element, ground plane spacing and characteristics of the dielectric substrate on which the antenna is formed. In many types of antenna element, antenna equivalent impedance changes significantly with frequency. This results in an impedance mismatch to the feed line when the antenna is operated outside a relatively narrow operational bandwidth. If the impedance of different parts of the circuit do not match, this can result in inefficient power transfer, unnecessary heating of components, and other problems. Consequently, the antenna element may not be usable except over a relatively narrow range of operating frequencies.

Two critical factors affecting the performance of the dielectric substrate material are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. These same factors affect the electrical length of an antenna element. Since antenna elements are typically designed to be a particular geometry and size relative to the wavelength of the operating frequency, the choice of the substrate material effects the overall size of the antenna element.

Moreover, conventional substrate materials typically have a permeability of 1. Accordingly, the choice of relative permittivity value for the dielectric substrate is usually a key design consideration. However, once a dielectric substrate material with a particular permittivity is selected, it is generally a static part of the design and cannot be readily changed. Accordingly, the use of conventional dielectric substrate arrangements have proven to be a limitation in designing antennas.

Further, it is known that the size of an antenna element required for a particular frequency can be reduced by selecting a dielectric substrate with a relatively high permittivity. One method of reducing antenna size is through capacitive loading. This can be accomplished through use of a high dielectric constant substrate for the array elements. For example, if dipole arms are capacitively loaded by placing them on a substrate of high relative permitivity substrate, the dipole arms can be shortened relative to the arm lengths which would otherwise be needed for a particular frequency using a lower dielectric constant substrate. This effect results because the electrical field in high dielectric substrate portion between the arm portion and the ground plane will be concentrated into a smaller dielectric substrate volume.

However, one drawback of this approach is that the radiation efficiency is often reduced. The readiation efficiency is the frequency dependent ratio of the power radiated by the antenna to the total power supplied to the antenna. In the case of a dipole, for example, a shorter arm length reduces the radiation resistance, which is approximately equal to the square of the arm length for a "short" (less than ½ wavelength) dipole antenna as shown below:

$$R_r = 20\,\pi^2 (l/\lambda)^2$$

where l is the electrical length of the antenna line and λ is the wavelength of interest.

A conductive trace comprising a single short dipole can be modeled as an open transmission line having series connected radiation resistance, an inductor, a capacitor and a resistive ground loss. The radiation efficiency of a dipole antenna system, assuming a single mode can be approximated by the following equation:

$$E = \frac{R_r}{(R_r + X_L + X_C + R_L)}$$

Where

E is the efficiency $R_r$ is the radiation resistance $X_L$ is the inductive reactance $X_C$ is the capacitive reactance $X_L$ is the ohmic feed point ground losses and skin effect The radiation resistance is a fictitious resistance that accounts for energy radiated by the antenna. The inductive reactance represents the inductance of the conductive dipole lines, while the capacitor is the capacitance between the conductors. The other series connected components simply turn RF energy into heat, which reduces the radiation efficiency of the dipole.

From the foregoing, it can be seen that the constraints of a dielectric substrate having selected relative dielectric properties often results in design compromises that can negatively affect the electrical performance and/or physical characteristics of the overall circuit. An inherent problem with the conventional approach is that, at least with respect to the substrate, the only control variable for line impedance is the relative permittivity. This limitation highlights another important problem with conventional substrate materials, i.e. they fail to take advantage of the other factor that determines characteristic impedance, namely $L_l$, the inductance per unit length of the transmission line.

SUMMARY OF THE INVENTION

The invention concerns an antenna that includes at least one antenna radiating element and a dielectric structure defining a cavity containing a fluid dielectric. The dielectric structure can be a dielectric circuit board substrate with a ground plane provided opposed to the antenna radiating elements. The fluid dielectric is electrically and magnetically coupled to the antenna radiating element. Further, a composition processor is provided for selectively varying a composition of the fluid dielectric so as to dynamically change an electrical characteristic of the antenna radiating element in response to a control signal.

The composition processor can vary a permittivity and a permeability of the fluid dielectric. According to one aspect of the invention, the permittivity and the permeability can be varied concurrently in response to the control signal. By selectively changing the fluid characteristics in this way, it is possible to dynamically modify an input impedance, a radiation efficiency, a resonant frequency and an electrical length of the antenna radiating element.

The antenna radiating element can be any one of a wide variety of well known microstrip type radiating elements. For example the antenna radiating element can be a dipole or a patch type antenna element. If a plurality of the antenna radiating elements are used, they can be provided with a suitable feed system and arranged to form an array.

The composition processor used with the invention can be implemented in a variety of different ways. For example, the composition processor can include one proportional valve and at least one mixing pump for dynamically mixing a plurality of component parts of the fluid dielectric responsive to the control signal to form the fluid dielectric. In that case, the component parts can be selected from among a low permittivity, low permeability component, a high permittivity, low permeability component, and a high permittivity, high permeability component, for mixing the plurality of component parts. A component part separator can also be provided for separating the component parts of the fluid dielectric for subsequent reuse.

The fluid dielectric can be comprised of an industrial solvent, that can have a suspension of magnetic particles contained therein. If magnetic particles are used, the magnetic particles can be formed of a material selected from the group consisting of ferrite, metallic salts, and organometallic particles. For example, the suspension of magnetic parts can contain between about 50% to 90% magnetic particles by weight.

The invention can also include a method for dynamically controlling an antenna. The method can be comprise the steps of electrically and magnetically coupling at least one antenna element to a fluid dielectric, and selectively varying a composition of the fluid dielectric in response to a control signal to dynamically change an electrical characteristic of the antenna. The method can also include the step of selectively varying at least one of a permittivity and a permeability of the fluid dielectric. The permittivity and the permeability can be varied independently or concurrently in response to the control signal. Consequently, the method can include modifying an input impedance, a radiation efficiency, a resonant frequency or an electrical length of the antenna radiating element.

The antenna radiating element can be selected to have a dipole configuration, a patch type antenna configuration, or any other microstrip antenna geometry. Moreover, the method can include the step of arranging a plurality of the antenna radiating elements to form an array.

The method can include the step of selecting a component part of the fluid dielectric from among a low permittivity, low permeability component, a high permittivity, low permeability component, and a high permittivity, high permeability component. It can also include the step of selectively mixing and communicating a plurality of component parts of the fluid dielectric from respective fluid reservoirs to a dielectric cavity disposed adjacent to the antenna radiating element. Finally, the method can include the step of separating a component part of the fluid dielectric for subsequent reuse.

DETAILED DESCRIPTION OF THE PREFERRED EMBODIMENTS

Figure 1:
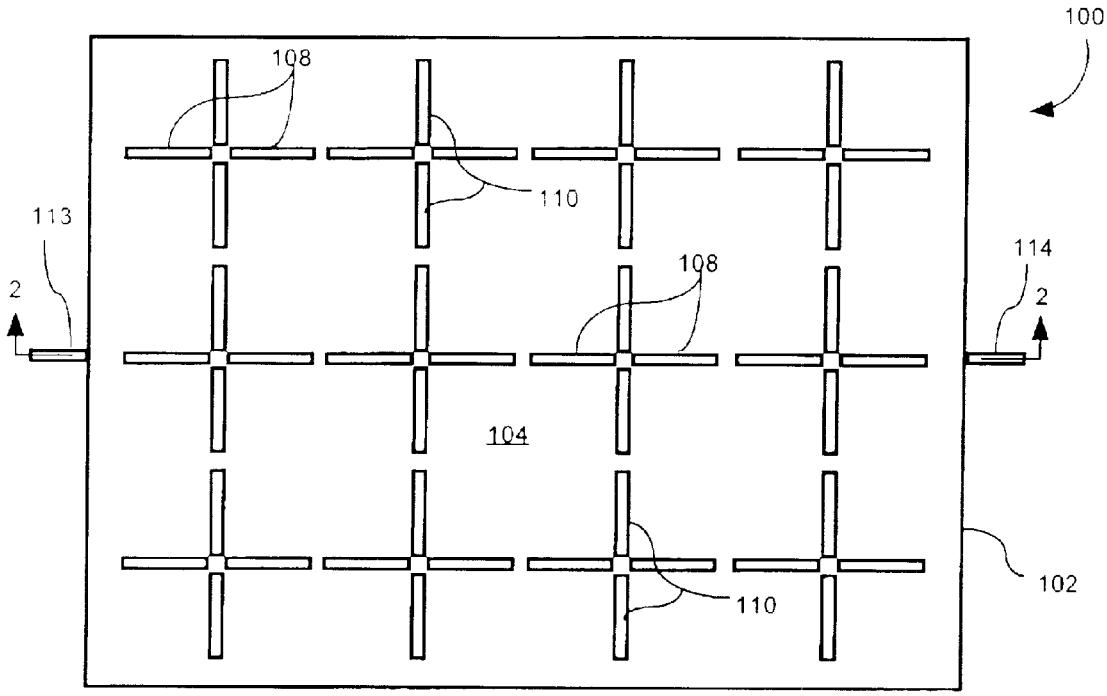
FIG. 1 is a top view of an array of antenna radiating elements that is useful for understanding the invention.
Figure 2:
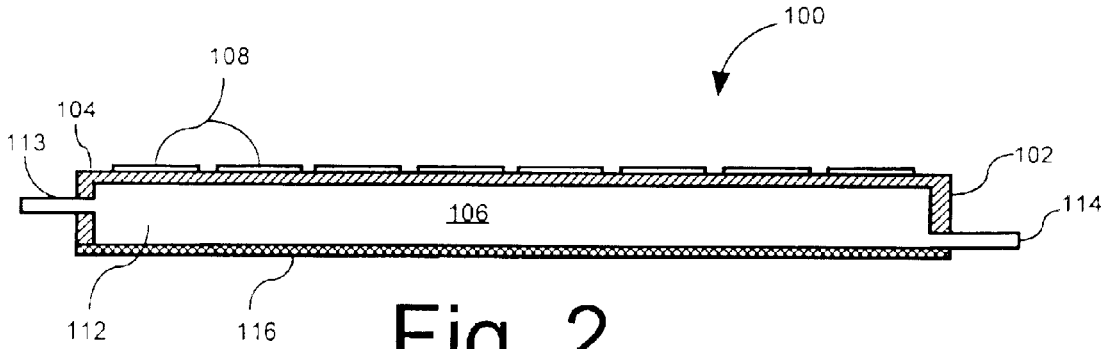
FIG. 2 is a cross-sectional view of the array of FIG. 1 taken along line 2—2.

Referring to FIG. 1, an antenna array 100 includes at least one antenna radiating elements 108, 110 and a dielectric structure 102 having a surface 104 on which the antenna radiating elements are supported. The antenna radiating elements 108, 110 in FIG. 1 are shown for purposes of illustration as simple dipole antenna elements. However, it should be understood that the invention as described herein can be used with any type of microstrip antenna configuration, including spiral and patch type antennas. According to a preferred embodiment, the dielectric structure 102 can be formed as a planar dielectric circuit board substrate with a ground plane 116 as shown in FIGS. 1 and 2. However, the invention is not so limited and other form configurations are also possible for implementing the dielectric structure 102.

It may be noted that in FIGS. 1 and 2, the RF feed circuitry has been omitted for purpose of greater clarity in understanding the invention. However, suitable feed circuitry arrangements for microstrip antennas are well known in the art. For example, dual feed line conductors could be routed through the dielectric structure 102 to the center of each set of dipole antenna elements. In order to minimize undesirable interaction between the feed structures and the antenna radiating elements, the feed line conductors could be routed perpendicular to the plane defined by the antenna radiating elements.

In addition to supporting the antenna radiating elements, the dielectric structure 102 can define at least one cavity structure 112 disposed adjacent to the antenna radiating elements 108, 110 as shown. In FIG. 2, a single fluid cavity extends beneath substantially the entire extent of surface 104 of dielectric structure 102. However, those skilled in the art will appreciate that other embodiments of the cavity structure are also possible. For example, instead of a single large fluid cavity coupled to all of the antenna radiating elements 108, 110, a plurality of smaller interconnected cavities could be arranged in more localized areas in those portions of the dielectric structure 102 that are physically adjacent to the antenna radiating elements. In any case the fluid cavity 112 preferably contains a fluid dielectric 106. The fluid dielectric is electrically and magnetically coupled to the antenna radiating elements 108, 110. Fluid input port 113 and output port 114 provide fluid access for circulating dielectric fluid into and out the cavity structure 112.

As will hereinafter be described in greater detail, a composition processor is provided for selectively varying a composition of the fluid dielectric 106 so as to dynamically change an electrical characteristic of the antenna radiating elements 108, 110 in response to a control signal. According to a preferred embodiment, the composition processor can vary a permittivity and a permeability of the fluid dielectric 106 and circulate the new fluid dielectric formulation into the cavity structure 112 as needed. The permittivity and the permeability can be varied independently or concurrently by the fluid processor in response to the control signal. By selectively changing the fluid characteristics in this way, it is possible to dynamically modify a variety of electrical characteristics associated with the antenna radiating elements 108, 110. For example, the fluid dielectric can be used to modify electrical characteristics including an input impedance, a radiation efficiency, a resonant frequency and an electrical length of the antenna radiating elements 108, 110.

Significantly, by modifying the permittivity and permeability of the fluid dielectric 106, antenna radiating elements 108, 110 of a selected physical size that are physically less than a quarter wave can be used efficiently at lower frequencies by increasing the permittivity and permeability of the fluid dielectric 106. Increasing permittivity and permeability can be used to modify the effective electrical length of the antenna radiating elements 108, 110. Notably, such a modification of the fluid dielectric also changes the effective electrical spacing between the ground plane 116 and the antenna radiating elements 108, 110.

Composition of Fluid Dielectric

The fluid dielectric can be comprised of several component parts that can be mixed together to produce a desired permeability and permittivity required for a particular antenna element electrical characteristic. In this regard, it will be readily appreciated that fluid miscibility and particle suspension are key considerations to ensure proper mixing. Another key consideration is the relative ease by which the component parts of the fluid dielectric can be subsequently separated from one another. The ability to separate the component parts is important when the antenna element electrical characteristic requirements change. Specifically, this feature ensures that the component parts can be subsequently re-mixed in a different proportion to form a new fluid dielectric.

The resultant mixture comprising the fluid dielectric also preferably has a relatively low loss tangent to minimize the amount of RF energy lost in the antenna radiating elements 108, 110. Also, the components of the fluid dielectric must be capable of providing the proper permittivity and permeability. Aside from the foregoing constraints, there are relatively few limits on the range of component parts that can be used to form the fluid dielectric. Accordingly, those skilled in the art will recognize that the examples of component parts, mixing methods and separation methods as shall be disclosed herein are merely by way of example and are not intended to limit in any way the scope of the invention.

Also, the component materials are described herein as being mixed in order to produce the fluid dielectric. However, it should be noted that the invention is not so limited. Instead, it should be recognized that the composition of the fluid dielectric could be modified in other ways. For example, the component parts could be selected to chemically react with one another in such a way as to produce the fluid dielectric with the desired values of permittivity and or permeability. All such techniques will be understood to be included to the extent that it is stated that the composition of the fluid dielectric is changed.

A nominal value of permittivity ($\epsilon_r$) for fluids is approximately 2.0. However, the component parts for the fluid dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluid dielectric with a permittivity anywhere within that range after mixing. Dielectric particle suspensions can also be used to increase permittivity.

According to a preferred embodiment, the component parts of the fluid dielectric can be selected to include a low permittivity, low permeability component and a high permittivity, high permeability component. These two components can be mixed as needed for increasing permittivity while maintaining a relatively constant ratio of permittivity to permeability. A third component part of the fluid dielectric can include a high permittivity, low permeability component for allowing adjustment of the permittivity of the fluid dielectric independent of the permeability.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluid dielectric after mixing. However, magnetic fluid compositions are typically between about 50% to 90% particles by weight. Increasing the number of particles will generally increase the permeability.

An example of a set of component parts that could be used to produce a fluid dielectric as described herein would include oil (low permittivity, low permeability), a solvent (high permittivity, low permeability) and a magnetic fluid, such as combination of an oil and a ferrite (low permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing the same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture.

Solvents such as formamide inherently posses a relatively high permittivty and therefore can be used as the high permittivity component for the invention. Permittivty of other types of fluid can also be increased by adding high permittivity powders such as barium titanate manufactured by Ferro Corporation of Cleveland, Ohio. For broadband applications, the fluids would not have significant resonances over the frequency band of interest.

Processing of Fluid Dielectric For Mixing/Unmixing of Components

Figure 3:
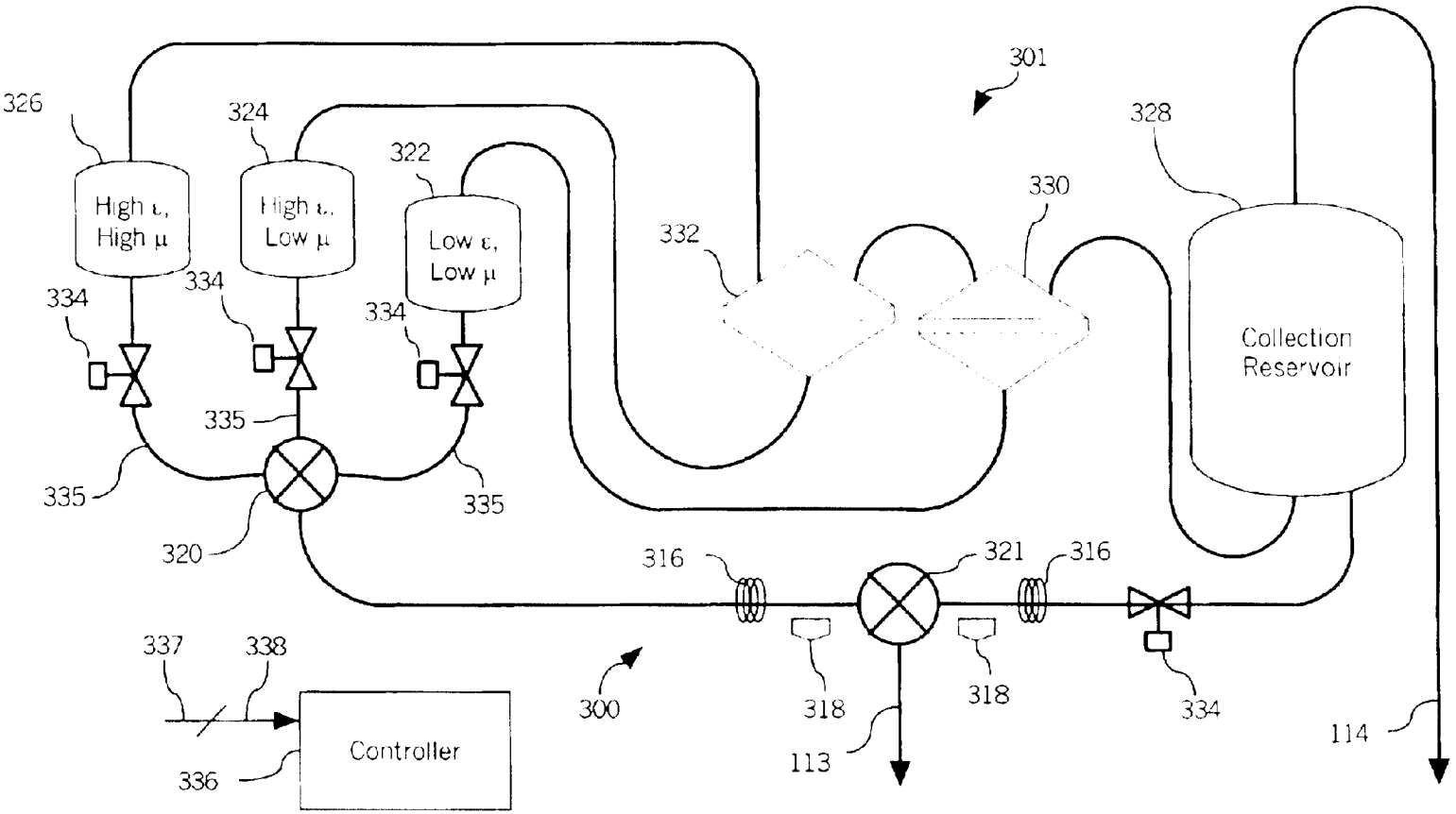
FIG. 3 is a schematic diagram of a composition processor that is useful for understanding the invention.

Referring now to FIG. 3, the composition processor 301 can be comprised of a plurality of fluid reservoirs containing component parts of fluid dielectric 106. These can include a first fluid reservoir 322 for a low permittivity, low permeability component of the fluid dielectric, a second fluid reservoir 324 for a high permittivity, low permeability component of the fluid dielectric, and a third fluid reservoir 326 for a high permittivity, high permeability component of the fluid dielectric. Those skilled in the art will appreciate that other combinations of component parts may also be suitable and the invention is not intended to be limited to the specific combination of component parts described herein.

A cooperating set of proportional valves 334, mixing pumps 320, 321, and connecting conduits 335 can be provided as shown in FIG. 3 for selectively mixing and communicating the components of the fluid dielectric 106 from the fluid reservoirs 322, 324, 326 to cavity structure 112. The composition processor 301 can also serve to separate out the component parts of fluid dielectric 106 so that they can be subsequently re-used to form the fluid dielectric with different permittivity and/or permeability values. All of the various operating functions of the composition processor can be controlled by controller 336. Dielectric fluid produced by the composition processor is communicated to the antenna array 100 by input port 113 and returned to the composition processor by output port 114. The operation of the composition processor shall now be described in greater detail with reference to FIG. 3 and the flowchart shown in FIG. 4.

Figure 4:
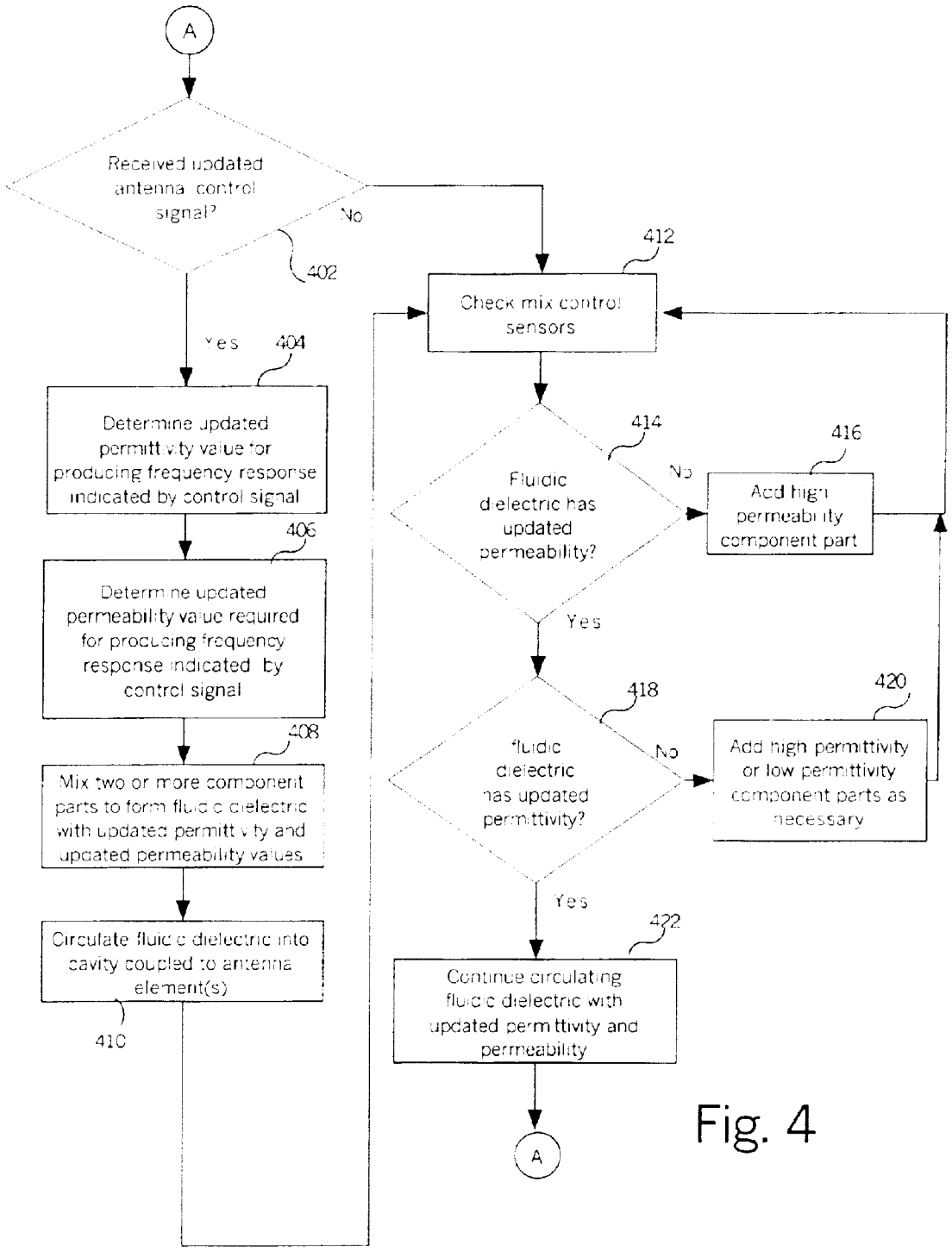
FIG. 4 flow chart that is useful for understanding the process of the invention.

The process can begin in step 402 of FIG. 4, with controller 336 checking to see if an updated antenna control signal 337 has been received on a control signal input line 338. If so, then the controller 336 continues on to step 404 to determine an updated permittivity value for producing the antenna element electrical characteristic indicated by the control signal. The updated permittivity value necessary for achieving the indicated antenna element electrical characteristic can be determined using a look-up table. Alternatively, the updated permittivity value can be calculated directly using equations well known to those skilled in the art for calculating capacitance per unit length. In step 406, the controller can determine an updated permeability value required for achieving the desired inductance per unit length for achieving the indicated electrical characteristic for antenna radiating elements 108, 110. Once again, this can be accomplished directly by calculation or through the use of a look up table.

In step 408, the controller 336 causes the composition processor 301 to begin mixing two or more component parts in a proportion to form fluid dielectric 106 that has the updated permittivity and permeability values determined earlier. This mixing process can be accomplished by any suitable means. For example, in FIG. 3 a set of proportional valves 334, conduits 335, and mixing pump 320 are used to mix component parts from reservoirs 322, 324, 326 appropriate to achieve the desired updated permeability and permittivity.

In step 410, the controller causes the newly mixed fluid dielectric 106 to be circulated into the cavity structure 112 through a second mixing pump 321. In step 412, the controller checks one or more sensors 316, 318 to determine if the fluid dielectric being circulated through the cavity structure 112 has the proper values of permeability and permittivity. Sensors 316 are preferably inductive type sensors capable of measuring permeability. Sensors 318 are preferably capacitive type sensors capable of measuring permittivity. The sensors can be located as shown, at the input to mixing pump 321. Alternatively, or in addition, sensors 316, 318 can also be positioned at the input and output of the cavity structure 112 so as to measure the permeability and permittivity of the fluid dielectric passing through input port 113 and output port 114. Note that it is desirable to have a second set of sensors 316, 318 at or near the cavity structure 112 so that the controller can determine when the fluid dielectric with updated permittivity and permeability values has replaced any previously used fluid dielectric that may have been present in the cavity structure 112.

In step 414, the controller 336 compares the measured permeability to the desired updated permeability value determined in step 406. If the fluid dielectric does not have the proper updated permeability value, the controller 336 can cause additional amounts of high permeability component part to be added to the mix from reservoir 326 and continues circulating the modified fluid dielectric 106 to the cavity structure 112. In general, it is desirable to increase permittivity and permeability in a ratio that is approximately constant so as to maintain antenna efficiency.

If the fluid dielectric 106 is determined to have the proper level of permeability in step 414, then the process continues on to step 418 where the measured permittivity value from step 412 is compared to the desired updated permittivity value from step 404. If the updated permittivity value has not been achieved, then high or low permittivity component parts are added as necessary in step 410 and the modified fluid is circulated to the cavity structure 112. If both the permittivity and permeability passing are the proper value, the system can stop circulating the fluid dielectric and the system returns to step 402 to wait for the next updated control signal.

Significantly, when updated fluid dielectric is required, any existing fluid dielectric can be circulated out of the cavity structure 112. Any existing fluid dielectric not having the proper permeability and/or permittivity can be deposited in a collection reservoir 328. The fluid dielectric deposited in the collection reservoir can thereafter be re-used directly as a fourth fluid by mixing with the first, second, and third fluids or separated out into its component parts in separator units 330, 332 so that it may be re-used at a later time to produce additional fluid dielectric. The aforementioned approach includes a method for sensing the properties of the collected fluid mixture to allow the fluid processor to appropriately mix the desired composition, and thereby, allowing a reduced volume of separation processing to be required.

According to a preferred embodiment, the component parts of the fluid dielectric 106 can be selected to include a first fluid made of a high permittivity solvent completely miscible with a second fluid made of a low permittivity oil that has a significantly different boiling point. A third fluid component can be comprised a ferrite particle suspension in a low permittivity oil identical to the first fluid such that the first and second fluids do not form azeotropes. Given the foregoing, the following process may be used to separate the component parts.

A first stage separation process in separator unit 330 would utilize distillation to selectively remove the first fluid from the mixture by the controlled application of heat for evaporating the first fluid, transporting the gas phase to a physically separate condensing surface whose temperature is maintained below the boiling point of the first fluid, and collecting the liquid condensate for transfer to the first fluid reservoir 322. A second stage process in separator unit 332 would introduce the mixture, free of the first fluid, into a chamber that includes an electromagnet that can be selectively energized to attract and hold the paramagnetic particles while allowing the pure second fluid to pass which is then diverted to the second fluid reservoir 324. Upon de-energizing the electromagnet, the third fluid would be recovered by allowing the previously trapped magnetic particles to combine with the fluid exiting the first stage which is then diverted to the third fluid reservoir 326.

Those skilled in the art will recognize that the specific process used to separate the component parts from one another will depend largely upon the properties of materials that are selected and the invention. Accordingly, the invention is not intended to be limited to the particular process outlined above.

RF Unit Structure, Materials and Fabrication

At this point it should be noted that while the embodiment of the invention in FIG. 2 is shown essentially in the form of a microstrip construction, the invention herein is not intended to be so limited. Instead, the invention can be implemented using other similar types of antennas, including those that are arranged in a buried microstrip configuration. Other types of antennas can also take advantage of the foregoing fluid dielectric techniques by replacing at least a portion of a conventional solid dielectric material that is normally coupled to the antenna with a fluid dielectric as described herein. All such structures are intended to be within the scope of the invention.

According to one aspect of the invention, the dielectric structure 102 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An antenna, comprising:

at least one antenna radiating element;

a dielectric structure defining a cavity containing a fluid dielectric, said fluid dielectric electrically and magnetically coupled to said antenna radiating element; and a composition processor for selectively varying a composition of the fluid dielectric so as to dynamically change an electrical characteristic of said antenna radiating element in response to a control signal.

2. The antenna of claim 1 wherein said composition processor selectively varies at least one of a permittivity and a permeability of said fluid dielectric.

3. The antenna of claim 2 wherein said composition processor selectively varies said permittivity and said permeability concurrently in response to said control signal.

4. The antenna of claim 1 wherein said electrical characteristic is at least one of an input impedance, a radiation efficiency, a resonant frequency and an electrical length of said antenna radiating element.

5. The antenna of claim 1 wherein said antenna radiating element is a dipole.

6. The antenna of claim 1 wherein an end of said antenna radiating element is a patch type antenna element.

7. The antenna of claim 1 wherein said antenna comprises a plurality of antenna elements arranged to form an array.

8. The antenna of claim 1 wherein said dielectric structure is a circuit board substrate.

9. The antenna of claim 8 further comprising a ground plane, said cavity disposed between said antenna radiating element and said ground plane.

10. The antenna of claim 1 wherein said composition processor further comprises a component mixer for dynamically mixing a plurality of component parts of said fluid dielectric responsive to said control signal to form said fluid dielectric.

11. The antenna of claim 10 wherein said component parts are selected from the group consisting of a low permittivity, low permeability component, a high permittivity, low permeability component, and a high permittivity, high permeability component.

12. The antenna according to claim 11 wherein said composition processor further comprises at least one proportional valve and at least one mixing pump for mixing said plurality of component parts.

13. The antenna of claim 12 wherein said composition processor further comprises a component part separator adapted for separating said component parts of said fluid dielectric for subsequent reuse.

14. The antenna of claim 1 wherein said fluid dielectric is comprised of an industrial solvent.

15. The antenna of claim 1 wherein at least one component of said fluid dielectric is comprised of an industrial solvent that has a suspension of magnetic particles contained therein.

16. The antenna of claim 15 wherein said magnetic particles are formed of a material selected from the group consisting of ferrite, metallic salts, and organo-metallic particles.

17. The antenna of claim 15 wherein said component contains between about 50% to 90% magnetic particles by weight.

18. A method for dynamically controlling an antenna comprising the steps of:

electrically and magnetically coupling at least one antenna element to a fluid dielectric; and responsive to a control signal, selectively varying a composition of said fluid dielectric to dynamically change an electrical characteristic of said antenna.

19. The method of claim 18 further comprising the step of selectively varying at least one of a permittivity and a permeability of said fluid dielectric.

20. The method of claim 19 further comprising the step of selectively varying said permittivity and said permeability concurrently in response to said control signal.

21. The method of claim 18 further comprising the step of varying said composition so as to modify at least one of an input impedance, a radiation efficiency, a resonant frequency and an electrical length of said antenna radiating element.

22. The method of claim 18 further comprising the step of selecting said at least one antenna radiating element to have a dipole configuration.

23. The method of claim 18 further comprising the step of selecting said at least one antenna radiating element to have a patch type antenna configuration.

24. The method of claim 18 further comprising the step of arranging a plurality of said antenna radiating elements to form an array.

25. The method of claim 18 further comprising the step of positioning said antenna radiating element on a circuit board substrate.

26. The method of claim 25 further comprising the step of constraining said fluid dielectric within a dielectric cavity structure.

27. The method of claim 26 further comprising the step of forming said dielectric cavity structure within a dielectric circuit board substrate.

28. The method of claim 27 further comprising the step of positioning said dielectric cavity structure between said antenna radiating element and a ground plane.

29. The method of claim 18 further comprising the step of selecting a component part of said fluid dielectric from the group consisting of a low permittivity, low permeability component, a high permittivity, low permeability component, and a high permittivity, high permeability component.

30. The method according to claim 18 further comprising the step of selectively mixing and communicating a plurality of component parts of said fluid dielectric from respective fluid reservoirs to a cavity disposed adjacent to said antenna radiating element.

31. The method of claim 18 further comprising the step of separating a component part of said fluid dielectric for subsequent reuse.

32. The method of claim 18 further comprising the step of selecting at least one component of said fluid dielectric to be an industrial solvent.

33. The method of claim 18 further comprising the step of selecting at least one component part of said fluid dielectric to be an industrial solvent that has a suspension of magnetic particles contained therein.

34. The method of claim 33 further comprising the step of selecting said magnetic particles from the group consisting of ferrite, metallic salts, and organo-metallic particles.

35. The method of claim 33 further comprising the step of selecting a ratio of said component parts so that said fluid dielectric contains between about 50% to 90% magnetic particles by weight.

* * * * *